US007530201B2

(12) United States Patent
Reynolds et al.

(10) Patent No.: US 7,530,201 B2
(45) Date of Patent: May 12, 2009

(54) CONNECTION NODE FOR A UNIVERSAL TRUSS JOINT AND DOUBLE LAYER GRID

(75) Inventors: Glenn A. Reynolds, Long Beach, CA (US); Dean R. Hackbarth, San Pedro, CA (US); Gary N. Curtis, Anacortes, WA (US)

(73) Assignee: Gossamer Space Frames, Long Beach, CA (US)

( * ) Notice: Subject to any disclaimer, the term of this patent is extended or adjusted under 35 U.S.C. 154(b) by 529 days.

(21) Appl. No.: 10/932,173

(22) Filed: Aug. 31, 2004

(65) Prior Publication Data

US 2006/0053726 A1 Mar. 16, 2006

(51) Int. Cl.
*E04B 7/08* (2006.01)

(52) U.S. Cl. ..... 52/81.3; 52/648.1; 52/638

(58) Field of Classification Search ..... 52/81.3, 52/648.1, 638, DIG. 10
See application file for complete search history.

(56) References Cited

U.S. PATENT DOCUMENTS

| | | | | |
|---|---|---|---|---|
| 2,284,898 | A | | 6/1942 | Hartman |
| 3,421,280 | A | | 1/1969 | Attwood et al. |
| 3,466,824 | A | | 9/1969 | Troutner |
| 3,688,461 | A | | 9/1972 | Rensch |
| 3,861,107 | A | | 1/1975 | Papayoti |
| 3,914,063 | A | | 10/1975 | Papayoti |
| 3,999,351 | A | | 12/1976 | Rensch |
| 4,070,847 | A | | 1/1978 | Madl, Jr. |
| 4,122,646 | A | * | 10/1978 | Sapp ..... 52/651.05 |
| 4,211,044 | A | | 7/1980 | Gugliotta et al. |
| 4,312,326 | A | | 1/1982 | Johnson, Jr. |
| 4,449,843 | A | | 5/1984 | Wendel |
| 4,476,662 | A | | 10/1984 | Fisher |
| 4,569,165 | A | * | 2/1986 | Baker et al. ..... 52/81.3 |
| 4,592,671 | A | | 6/1986 | Daum |
| 4,904,108 | A | * | 2/1990 | Wendel ..... 403/173 |
| 5,022,209 | A | | 6/1991 | Kimura |
| 5,224,320 | A | * | 7/1993 | Mai ..... 52/648.1 |
| 5,375,389 | A | | 12/1994 | Kimura |

OTHER PUBLICATIONS

Ariel Hanaor, Special Issue on "Prefabricated Spatial Frame Systems", International Journal of Space Structures, vol. 10 No. 3 1995, 55 Pages; Multi-Science Publishing Co., Ltd.; UK.

* cited by examiner

*Primary Examiner*—Richard E Chilcot, Jr.
*Assistant Examiner*—Jessica Laux
(74) *Attorney, Agent, or Firm*—Christie, Parker & Hale, LLP.

(57) ABSTRACT

A connection node for a double layer grid or truss system has at least one diagonal flange receiving a pair of diagonal framing members having surfaces that lie in a single diagonal plane parallel to the flange(s). Use of co-planar diagonal members that can be at various diagonal angles or vertical, simplifies node connections and permits variations in bay spacing to produce interesting architectural effects and to provide greater member density where structural loads are greater.

16 Claims, 15 Drawing Sheets

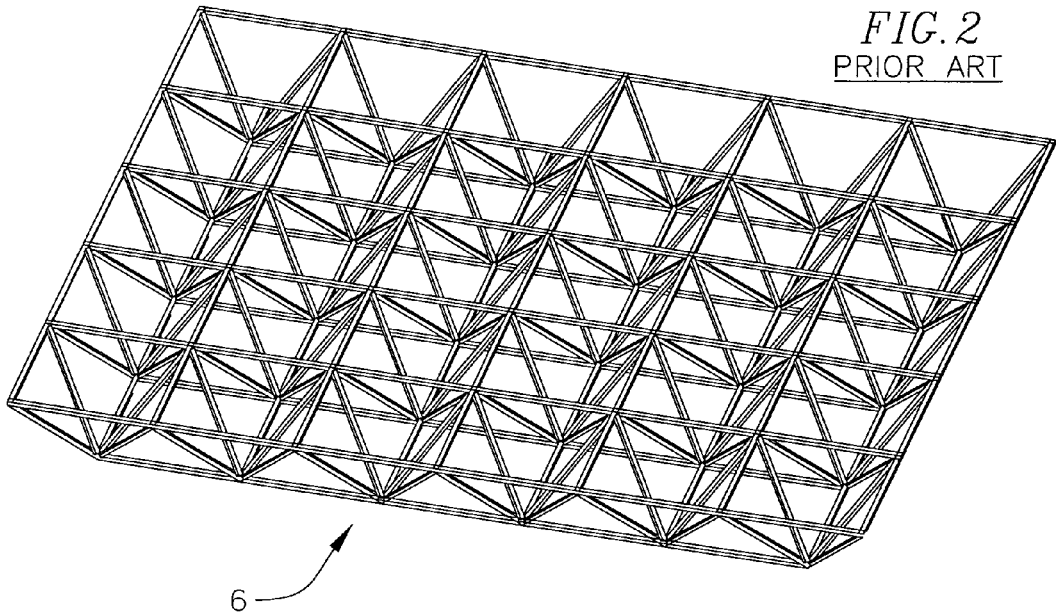
FIG. 2
PRIOR ART
FIG. 3
PRIOR ART
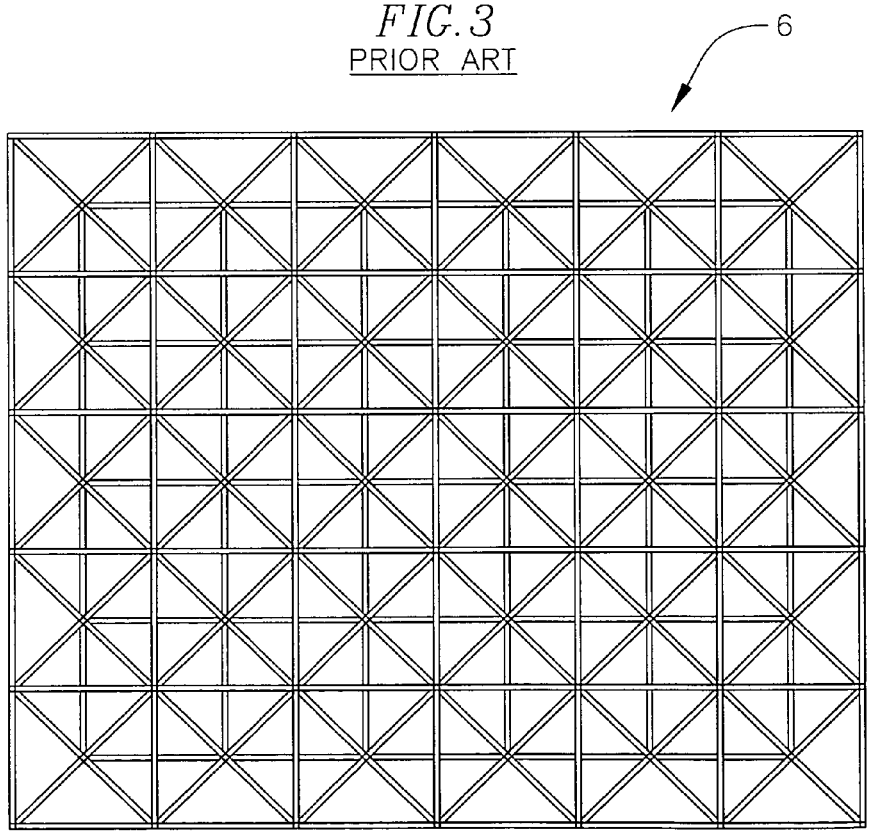

CONNECTION NODE FOR A UNIVERSAL TRUSS JOINT AND DOUBLE LAYER GRID

FIELD OF THE INVENTION

The present invention relates to connections for joining linear, structural elements capable of carrying tension and compression loads that comprise double-layer-grid, three-dimensional trussed structures and braced planar truss systems. The most common application of such connections is in double-layer-grid space frames. Therefore, the connection hereof is named after the acronym for double-layer-grid—the DLG Connector (DLGC).

BACKGROUND ART

Current connections designed for double-layer-grids receive linear, structural elements that, most commonly, are either round or square in cross-section. In such grids, the places where plural linear elements are interconnected are known as "nodes". FIG. 1 illustrates a conventional node connector 2 for square cross-section framing members 3, 4. Note that the adjacent diagonal strut members at 4 the connection reside in different planes. That is, the non-vertical surfaces 5 of each diagonal strut member 4 lie in (or are parallel to) a plane diagonal to the common plane of the adjacent horizontal chord members 3 which is different from the diagonal plane of each other diagonal strut member associated with the connector.

Bolted connections are easily effected using these systems that accommodate square linear, tubular structural elements. The use of a square cross-section for the framing is advantageous since the fabrication of the framing member consists simply of drilling or punching holes at both ends after the member is cut to length. Ball-node systems are designed for the use of round cross-sections (pipes) in double-layer-grids and involve a more expensive design and fabrication process.

A double-layer-grid is understood to be a structure with a horizontal, square grid of framing elements that serve as the top chords and is the top "layer" of the DLG space frame. Similarly, there are the bottom chords with the same square grid that is offset horizontally by one-half the bay width in both directions. This bottom "layer" is also offset downwardly from the top "layer" by a set distance and is held in position by the use of diagonal (strut) framing elements. FIGS. 2, 3 & 4 show a typical double-layer-grid space frame 6, six bays long by five bays wide; an end view of frame 6 is similar to FIG. 4. There are several disadvantages of the connection systems of the prior art when applied to double-layer grids as described with square cross-section framing elements. First, these systems are restricted to square, double-layer-grids only. Second, these systems can only produce flat double-layer grids. Third, contoured (free-form) footprints are difficult to design and construct. Fourth, vertical sidewall and/or end wall framing is difficult to design and construct. These disadvantages are resolved with the DLGC design.

SUMMARY OF THE INVENTION

The DLGC takes advantage of natural planes formed by the double-layer grid. When studying a double-layer-grid, the observer will see in FIG. 4 that the diagonal members in each half-bay all lie in the same plane. As long as the diagonal framing elements have flat surfaces, such as square/rectangular tubes, angles, channels and I-beams (wide flanged sections as in steel construction), these strut framing elements can be rotated so that the non-vertical surfaces of the strut framing elements become parallel to the diagonal plane. Once the framing element is oriented so that the non-vertical flat surface(s) are in plane with the diagonals, the problem of attachment is immensely simplified. In current systems as shown in FIGS. 1, 5, 6 and 7 (FIGS. 5, 6 and 7 are simplified, and idealized, depictions of the substance of FIG. 1), opposing diagonal elements have their major axes (webs) residing in vertical planes. The present DLGC system makes adjacent diagonal elements have their non-vertical surface features co-planar, as shown in FIGS. 8-10, e.g. When these surface features are oriented in the same plane, they become parallel to the plane defined by the row of diagonal elements. Once this is accomplished, adjacent diagonals can be connected to the joint by the same structural plates. Sharing structural plates at the connection as seen in FIGS. 8, 9 and 10 creates the simplified connection. The members comprising the horizontal grid attaching to the diagonal elements can also be connected together with plates following the direction of the diagonal plane. This allows for a system of plate flanges with parallel centerlines that is ideal for fabrication as aluminum extrusions or welded steel plates that comprise a DLGC joint (see FIGS. 11, 12 and 13).

The DLGC can be made of any structural material such as, but not limited to, aluminum, steel, fiber-reinforced polymers (FRP) and plastics. Fabrication of the DLGC can use any process suitable to the material used such as extruding or casting aluminum and welding steel plates. Linear members connected by the DLGC can be made of any structural material such as, but not limited to, aluminum, steel, FRP, plastic or wood.

Generally speaking, a node connector according to this invention is useful for interconnecting plural structural framing members at a node in a double-layer space frame which has spaced major surfaces. The major surfaces are defined by substantially orthogonally disposed chord members. The major surfaces are spaced from each other by struts. The node connector comprises an elongate body which has a substantially constant transverse cross-sectional configuration along its length. The connector body defines an elongate open-ended passage which has side walls and which is configured and sized to enable a first chord to be engaged in and along the passage between the side walls in one major surface of the frame. The connector body also defines at least first and second pairs of spaced parallel diagonal surfaces. Each pair of diagonal surfaces is associated with a respective one of two diagonal planes which intersect at a line parallel to the elongate extent of the passage. The diagonal surfaces in each pair are parallel to a respective diagonal plane. The ends of a pair of frame struts can be connected to the connector between each pair of diagonal surfaces.

Another aspect of this invention pertains to a double layer space frame which has longitudinal and transverse chord structural framing members which are orthogonally disposed in spaced major surfaces of the frame. The chord members are connected relative to each other by connectors at connection nodes in the frame major surfaces. The frame also includes pairs of strut structural framing members which lie in diagonal planes oblique to the frame's major surfaces and which connect a node in one major surface to four adjacent nodes in the other major surfaces. A connector at such a node has at least two pairs of struts connected to it. In that context, a connector comprises a body which has a passage through it which receives a first frame chord member. The connector has lateral surfaces which extend away from opposite sides of the passage; to each lateral surface is connected a further chord member which is disposed substantially orthogonally to the first chord member. The connector body also has at least two diagonal surfaces which extend along the body parallel to the passage and respectively parallel to a respective one of two diagonal planes associated with that node. The ends of a pair of struts in the related diagonal plane are connected to each diagonal surface to connect the node to two adjacent nodes in the other major surface of the frame.

BRIEF DESCRIPTION OF THE DRAWINGS

The aforementioned features and advantages of the present invention, as well as additional features and advantages thereof, will be more fully understood from the following detailed description of a preferred embodiment when taken in conjunction with the accompanying drawings in which:

FIGS. 2, 3 and 4 are isometric, plan and side views, respectively, of a conventional (prior art) double layer grid that is six bays long and five bays wide;

DETAILED DESCRIPTION OF PREFERRED EMBODIMENTS

Figure 1:
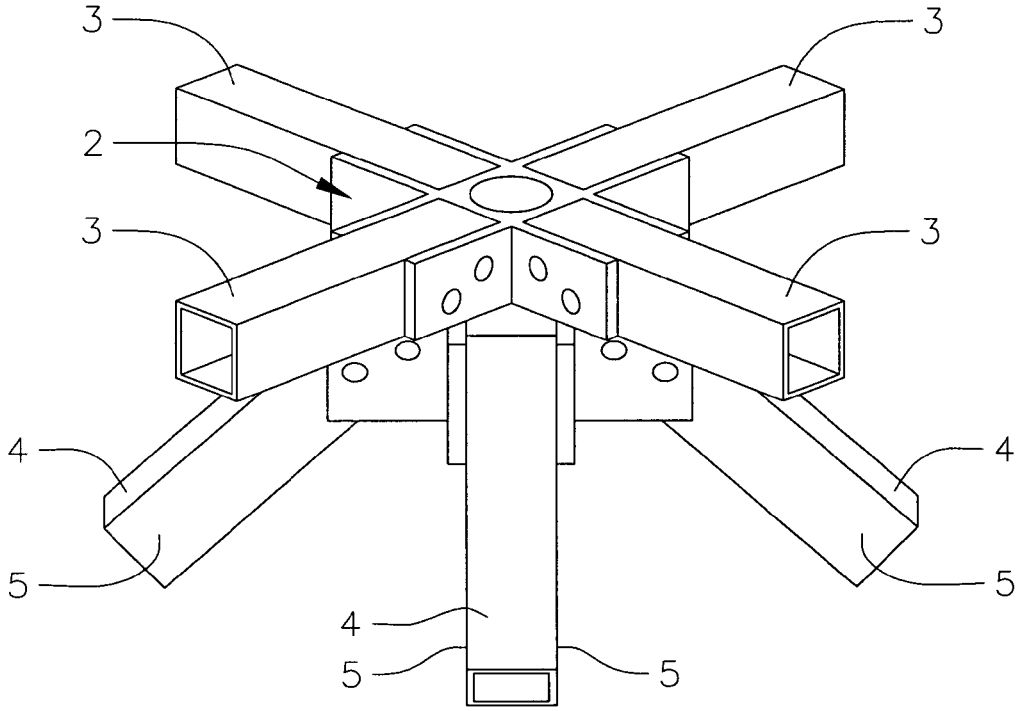
FIG.1 PRIOR ART
FIG. 1 is a perspective depiction of a prior art node connection using conventional connection technology where the diagonal members' non-vertical surfaces lie in different planes in order to maintain their respective vertical orientations.
Figure 4:
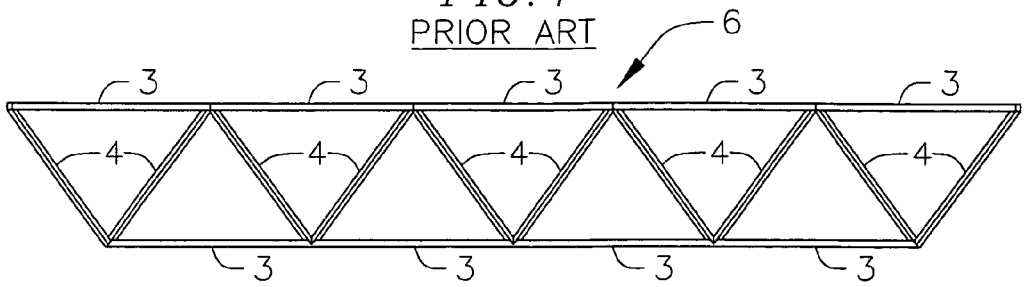
FIG. 4 PRIOR ART
Figure 5:
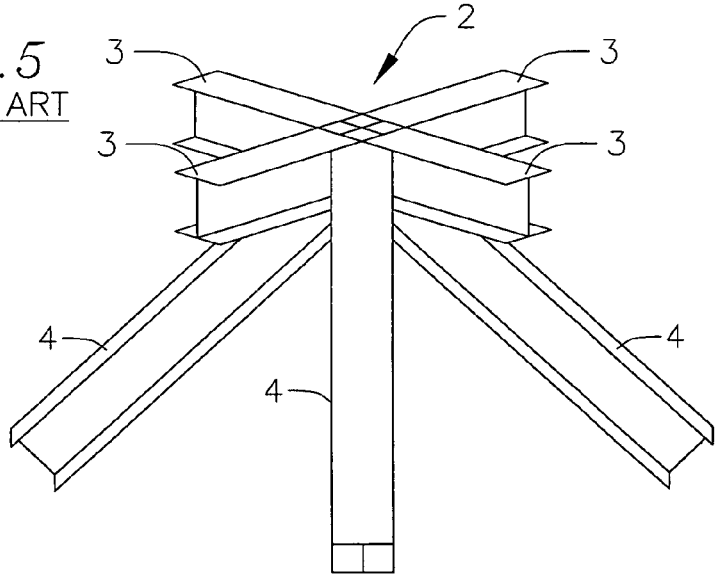
FIG. 5 PRIOR ART
FIGS. 5, 6 and 7 are simplified isometric, bottom and side views, respectively, of a conventional (prior art) node connection, generally like that shown in FIG. 1, in a double layer grid.
Figure 6:
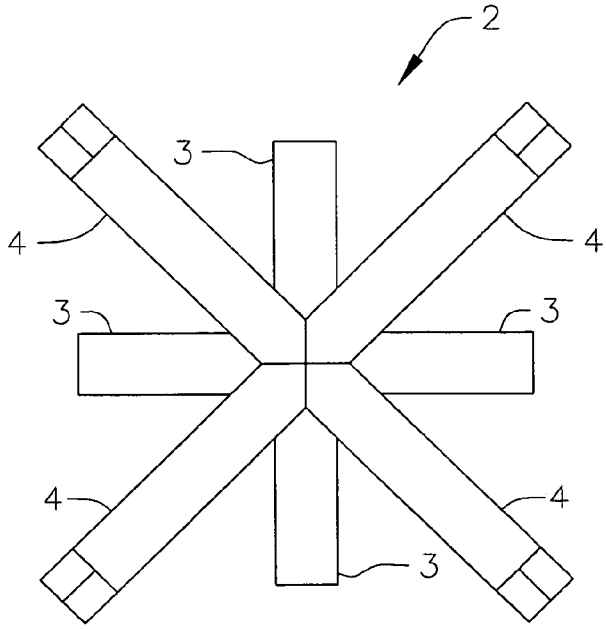
FIG. 6 PRIOR ART
Figure 7:
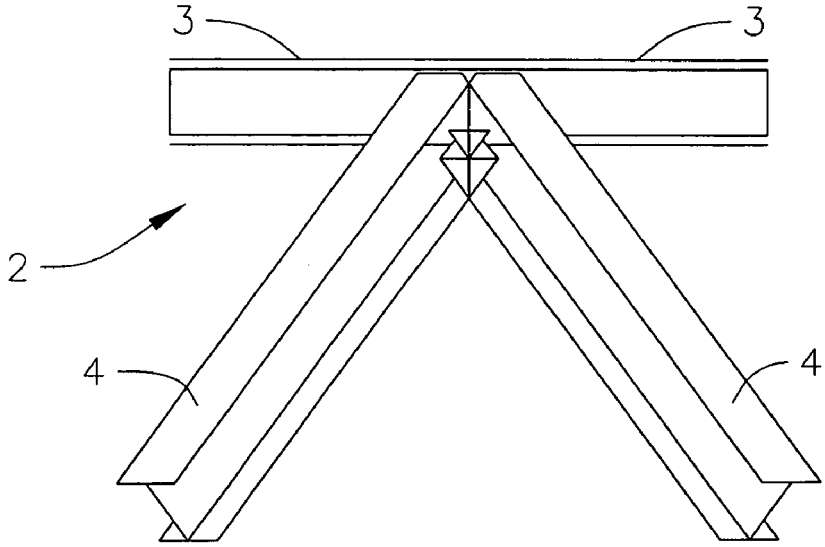
FIG. 7 PRIOR ART

FIGS. 5 through 7 depict a simplified representation of prior art node connector joint 2 (see FIG. 1) and illustrate the existing convention for member orientation in conventional double-layer-grids. Wide-flanged (WF) members are shown for grid framing members 3, 4 in FIGS. 5-7 to help visualize strut member orientation. As seen in FIG. 5, the diagonal member in the foreground has the web oriented vertically as do the other diagonal members connected to that node connection joint. FIG. 6 shows the same joint 2 in a bottom view in which the intersections of the diagonal struts 4 trace a cruciform which indicates that the flat flange surfaces of the WF diagonals are in separate planes. FIG. 7 is a close-up of a joint from space frame 6 (see FIG. 4) which illustrates that the flanges of the strut 4 members are not parallel to the plane defined by the row of diagonals in each half-bay.

Figure 8:
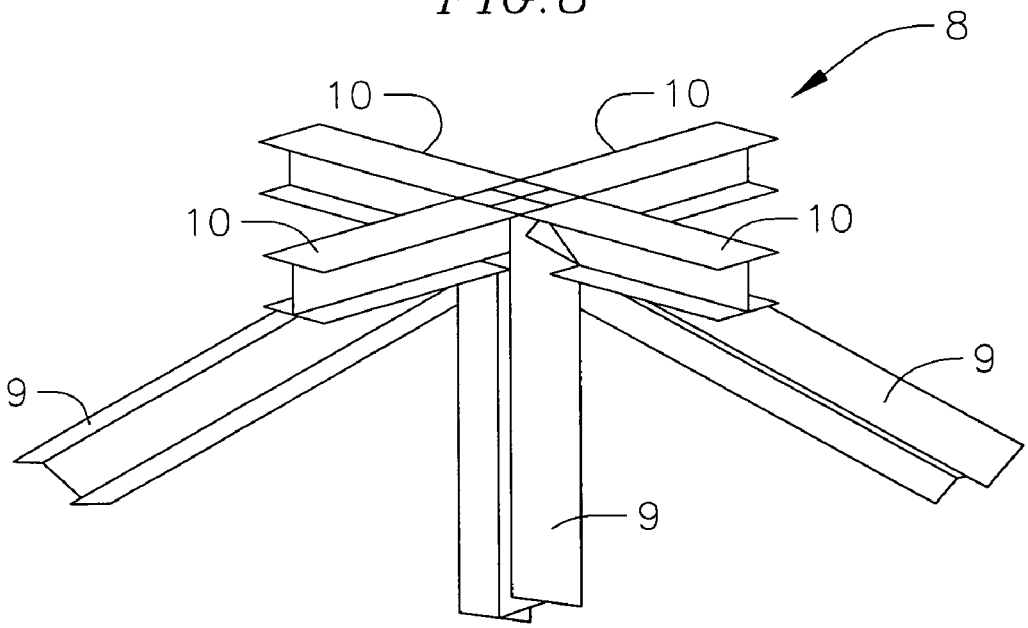
FIGS. 8, 9 and 10 are conceptual (simplified and idealized) isometric, bottom and plan views, respectively, of a node connection of a double layer grid according to the present invention.
Figure 9:
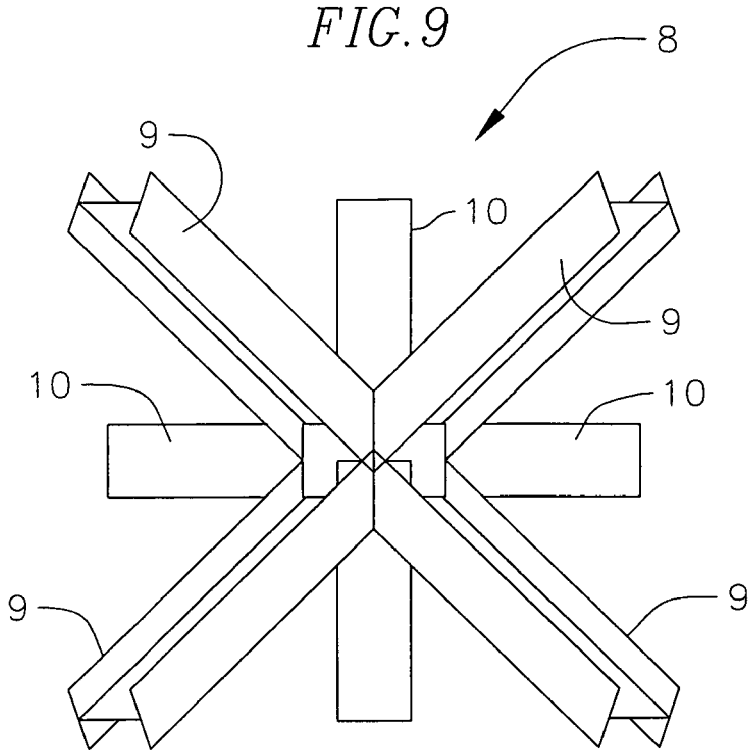
Figure 10:
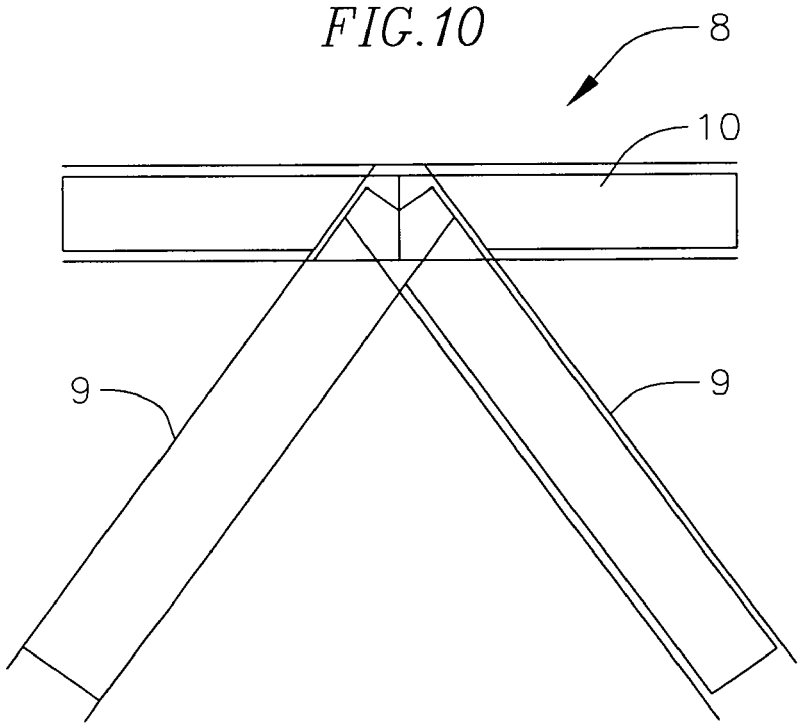

A simplified depiction of a DLGC joint 8 according to the present invention is shown in FIG. 8 which reveals that the webs of WF strut members 9 in a DLG node connection of the present invention are not in a vertical orientation; chord framing members 10 are also involved in joint 8. FIG. 9 demonstrates that opposite pairs of diagonal strut 9 have a strut member orientation that makes their flange surfaces co-planar as evidenced by a straight line at the intersection of the four struts—two intersecting planes make a straight line. FIG. 10 verifies that the flanges of each pair of adjacent strut members 9 on one side of the node connection are oriented so that they are now parallel to the diagonal plane. This way of orienting diagonal elements makes the DLGC possible. Working joint designs based on this innovation are presented next.

Figure 11:
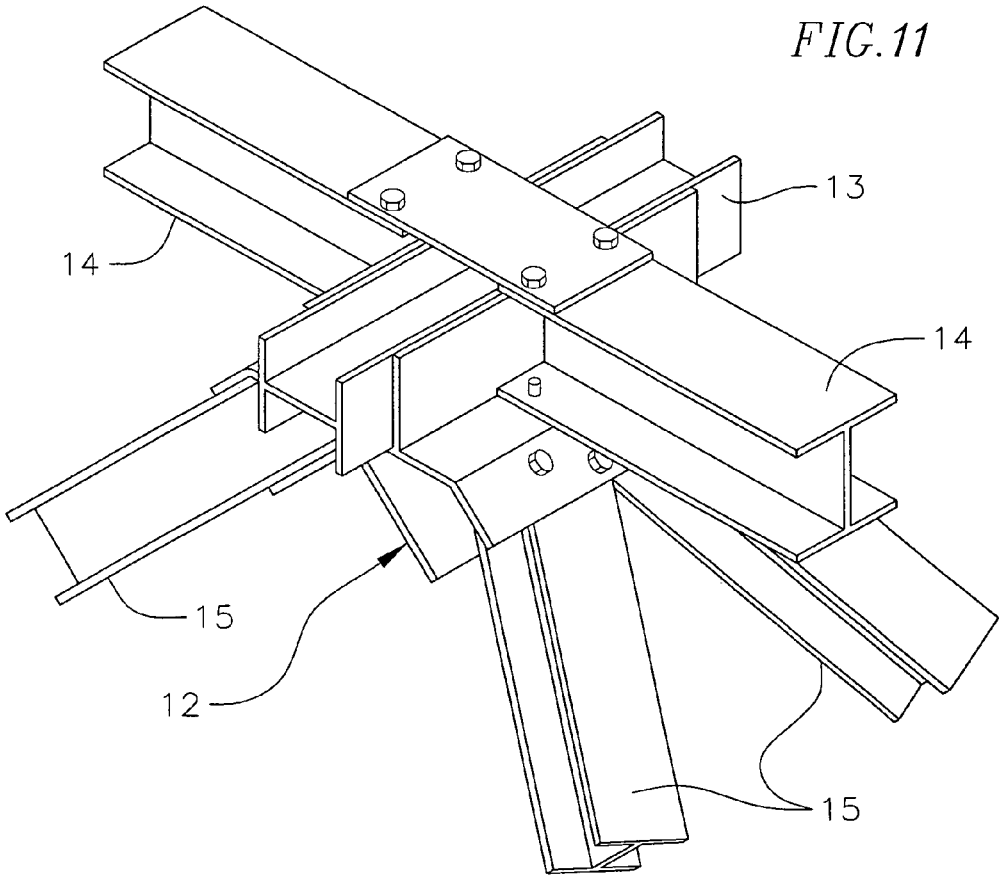
FIGS. 11, 12 and 13 are isometric, bottom, and cross-section views, respectively, of a first embodiment of a DLGC node connection of the invention in which the framing members of the DLG are defined by WF (wide flange) shapes.
Figure 12:
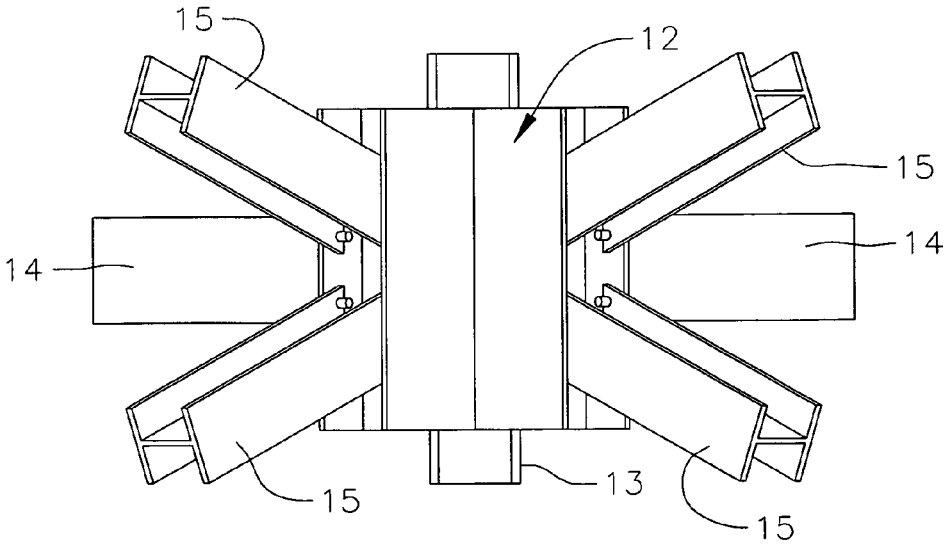
Figure 13:
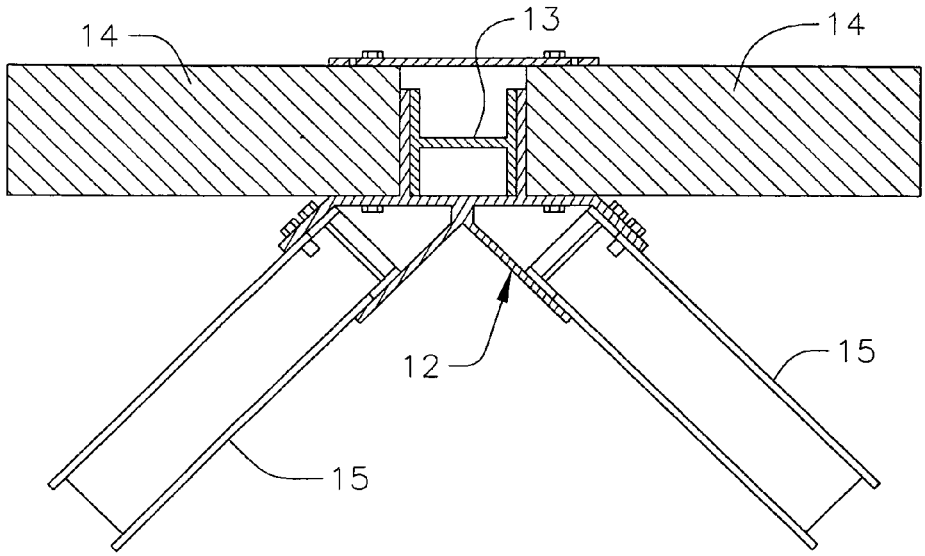
Figure 14:
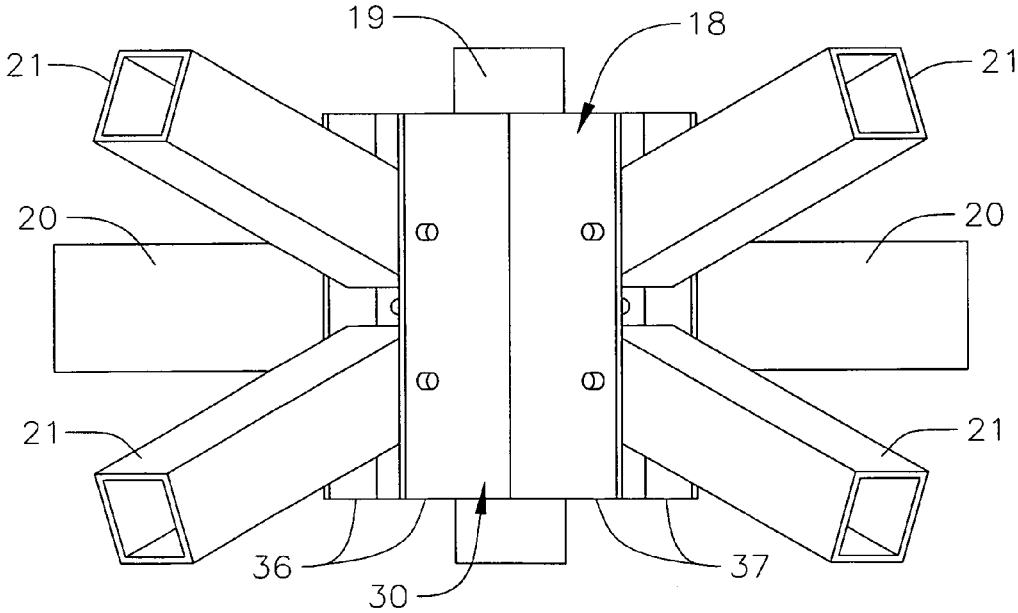
FIGS. 14 and 15 are bottom and transverse cross-section views, respectively, of a version of the invention in which the grid framing elements are defined by square tubes.
Figure 15:
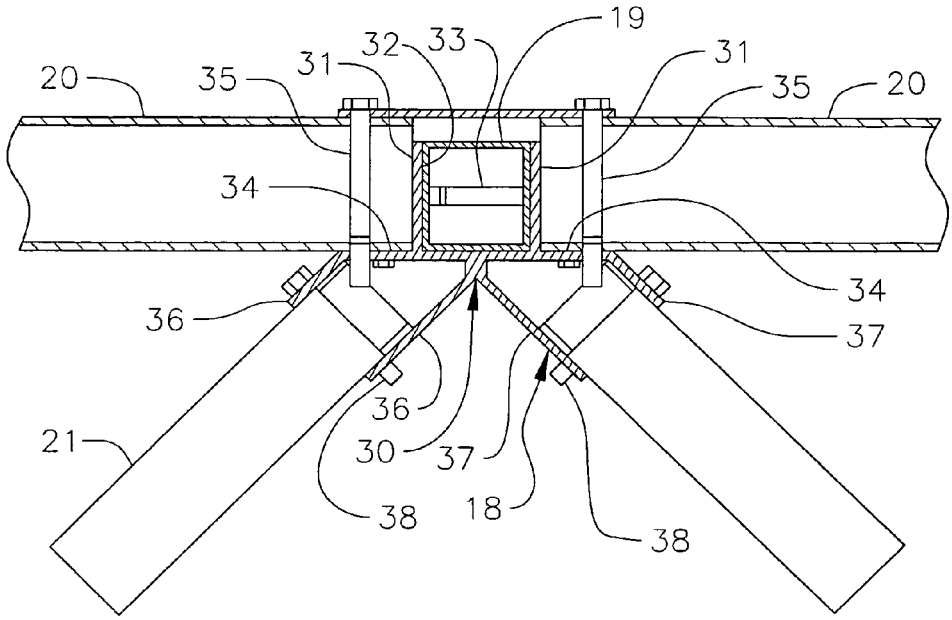
Figure 16:
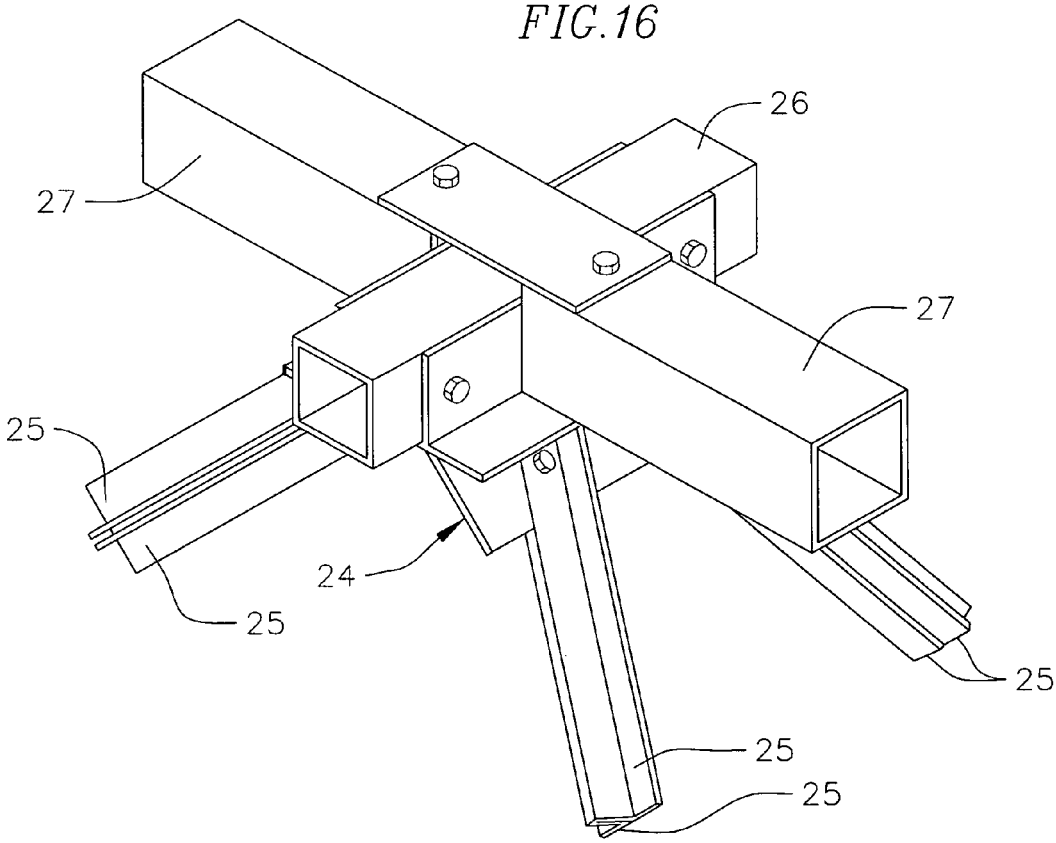
FIGS. 16, 17 and 18 are isometric, bottom and transverse cross-sectional elevation views, respectively, of a version of the invention in which the strut framing members are back-to-back angle pairs and the chord framing members are squares tubes.
Figure 17:
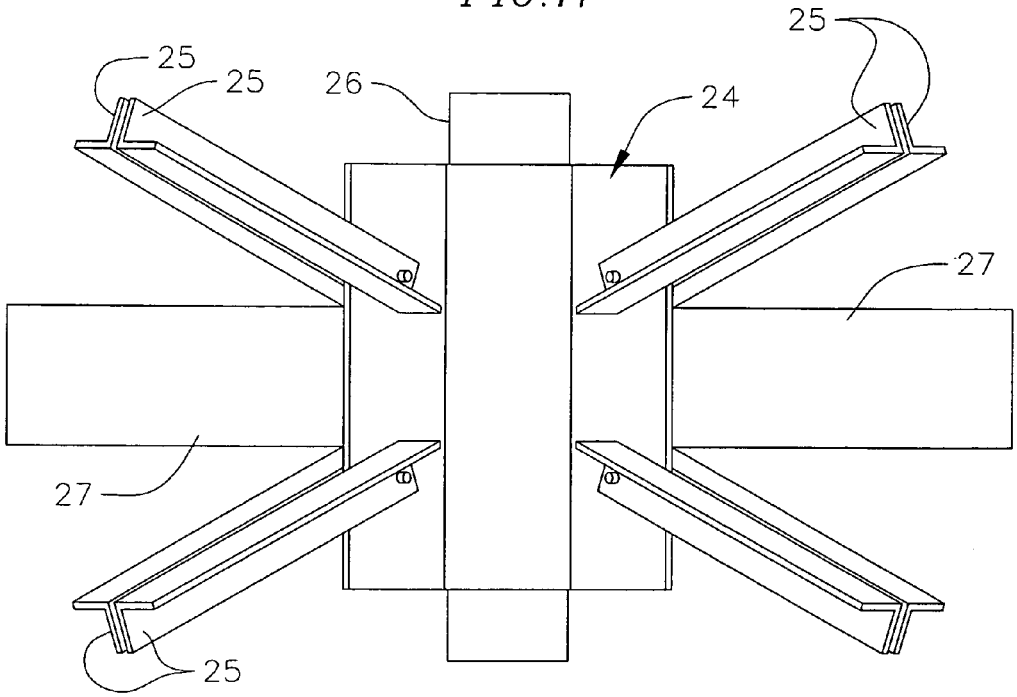
Figure 18:
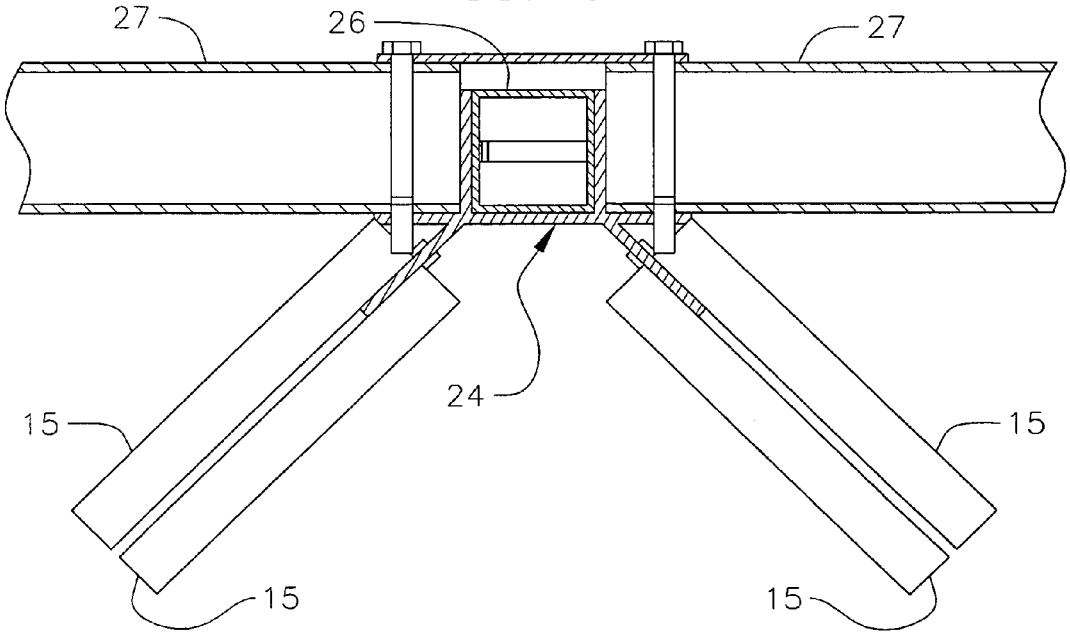

Shown in FIGS. 11 through 13 is one working embodiment of the present DLGC. This node connector 12 is designed to be extruded aluminum for the joining of aluminum chords 13, 14 and strut 15 members; in this example, those chords and struts are WF aluminum shapes. FIGS. 14 and 15 show a preferably extruded connector 18 with square aluminum tubes as chords 19, 20 and struts 21. FIGS. 16-18 illustrate a similar preferably extruded connection 24 with back-to-back angles used to define struts 25; chord members 26 and 27 are defined by square tubes. Similar constructions can be produced in steel with the DLGC consisting of welded steel plates instead of an extrusion. The DLGC also provides for using engineered wood and sawn lumber as strut members.

Figure 19:
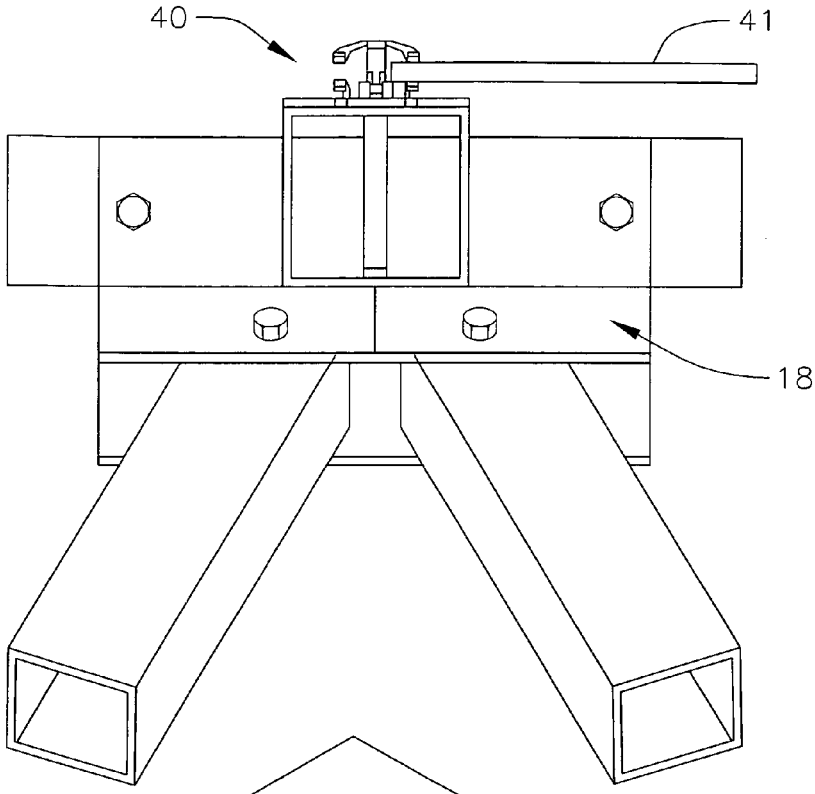
FIG. 19 is an illustration of a connection of the invention which incorporates a mullion/rafter system for glazing with glass, polycarbonate or acrylic sheets.
Figure 20:
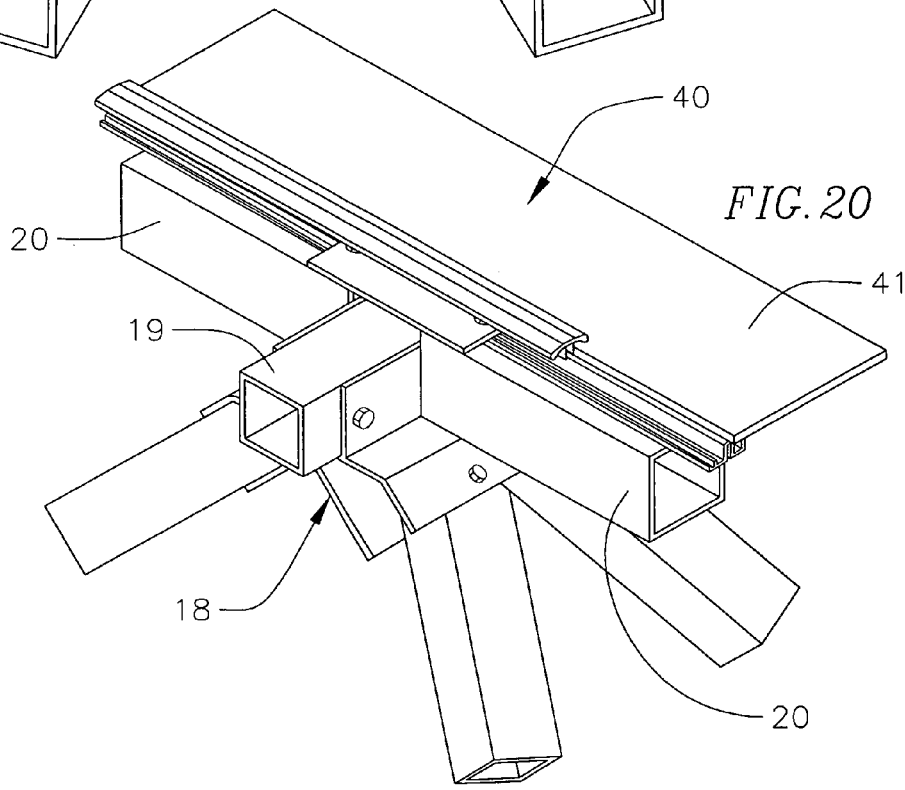
FIG. 20 is an isometric view of the connector of FIG. 19 with a glass sheet shown on one side only.

FIG. 19 illustrates that the DLGC can incorporate a mullion/rafter system 40 for glazing with panels 41 of glass, polycarbonate or acrylic. FIG. 20 is an isometric view with glass shown only on one side for clarity. Additionally, similar attachments can be integrated with the DLGC system that would allow for the batten engagement of sheet metal panels. In all these cases, the cladding engagement mechanism can be produced integrally with the rafters of the top chords in one or both directions. Once the cladding engagement mechanism is made integrally with the rafter, no secondary framing is required to support the cladding. The top chord members can serve as mullions.

An inspection of FIGS. 11-13 concerning node connector 12, of FIGS. 14-15 concerning node connector 18, and of FIGS. 16-18 concerning node connector 24 reveals that connectors 12, 18, and 24 have certain structural features and properties in common with each other. Those common features and properties are discussed herein principally with reference to FIGS. 14 and 15 and connector 18. Connector 18 is comprised by an elongate body 30 which preferably has a constant transverse cross-sectional configuration and which, more preferably, is created by an aluminum extrusion process. Body 30 includes a pair of spaced parallel flanges 31 oriented along the length of the body to form an open ended passage 32 in which is received a chord member 19 of the pertinent space frame. Passage 32 has side walls defined by the opposing surfaces of flanges 31. As received in the passage, the chord extends along the passage and, in some instances as shown 14, through the passage in a continuous manner to extend beyond the opposite ends of the passage. In connector 30, the passage has a bottom and an open side opposite that bottom so that the connector can be engaged laterally with chord 19 where desired along the length of the chord, with the chord engaging the passage bottom; the body 30 can be secured to chord 19 by pins 33, e.g., passed through flanges 31 and the chord as shown in FIG. 15.

Also by inspection of FIGS. 14 and 15, body 30 of connector 18 defines surfaces 34 extending laterally in the body away from passage 32 in preferably coplanar relation, preferably from the lower ends of flanges 31 as seen in FIG. 15. The ends of chords 20, disposed orthogonally to chord 19 as shown in FIG. 14, can be connected to surfaces 34 by pins 35, e.g. Further, in connectors 12 and 14, the connector body defines two pairs 36, 37 of diagonal flanges. The flanges 36 and 37 in each diagonal flange pair have opposing diagonal surfaces which extend along the length of passage 32 (i.e., the length of body 30) parallel to the length of the passage; they also extend away from the passage parallel to each other and diagonally relative to the adjacent lateral surface 34 to, in effect, define a space frame diagonal plane in which lie the two struts 21 disposed on one side of chord 19 as received in connector passage 32. Flange pairs 36, 37 extend as described and shown from opposite sides of passage 32. The ends of struts 21 which extend away from one side of chord 19 are disposed between the flanges of one flange pair 36, and the ends of the struts which extend away from the other side of chord 19 are disposed between the flanges of the other flange pair 37, the pairs of struts lying in their respective diagonal planes in the space frame. The end of each of strut 21 can be secured to the connector by a single pin 38 passing through aligned holes in the adjacent flanges 36, 37 and through the chord preferably perpendicularly to the flanges. The diagonal flange pairs 36, 37 preferably are located and oriented in connector 18 relative to passage 32 so that the diagonal planes defined by (associated with) flanges 36, 37 intersect at a line within and extending along passage 30. The line of intersection of the diagonal planes preferably coincides with the centerline (axis) of passage 32. The struts preferably are so located along the length of their respective diagonal flanges, in combination with the included angle between the struts in each strut pair, that the axes of the struts intersect at a common point on that line of diagonal plane intersection. Regardless of the angle of a given strut relative to connector body 30, the strut will be in the diagonal plane defined by the diagonal flange pair (or single diagonal flange in the case of connector 24 shown in FIGS. 16-18) to which the strut is connected.

It is apparent from the content of the proceeding two paragraphs that connectors 12, 18 and 24 have an aspect of directionality to them. The direction of a connector according to this invention is the direction along the connector passage and along the lengths of the diagonal flanges along the connector body. Also, the fact that a strut connected to such a connector will always lie in the diagonal plane defined by, or associated with, the diagonal flange(s) to which it is connected makes it possible to construct DLG space frames having variable bay spacing in one direction of the frame, as shown in FIGS. 26-29 discussed more fully later in this description.

Figure 21:
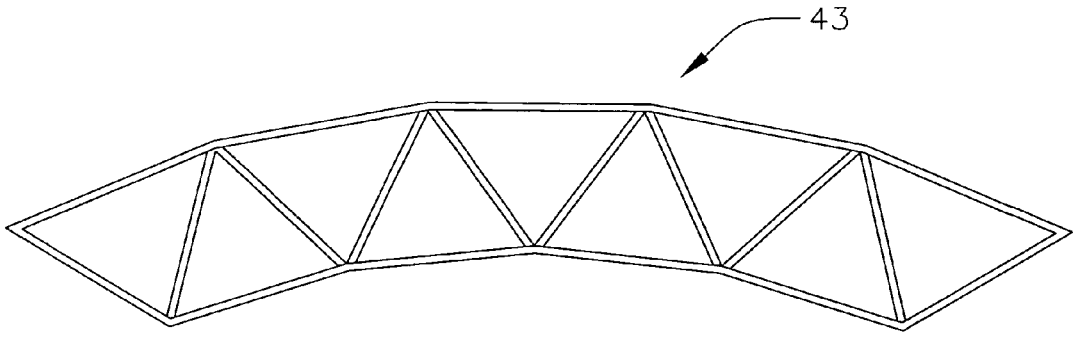
FIGS. 21 and 22 are side and isometric views, respectively, of a DLG in arch or vaulted shape.
Figure 22:
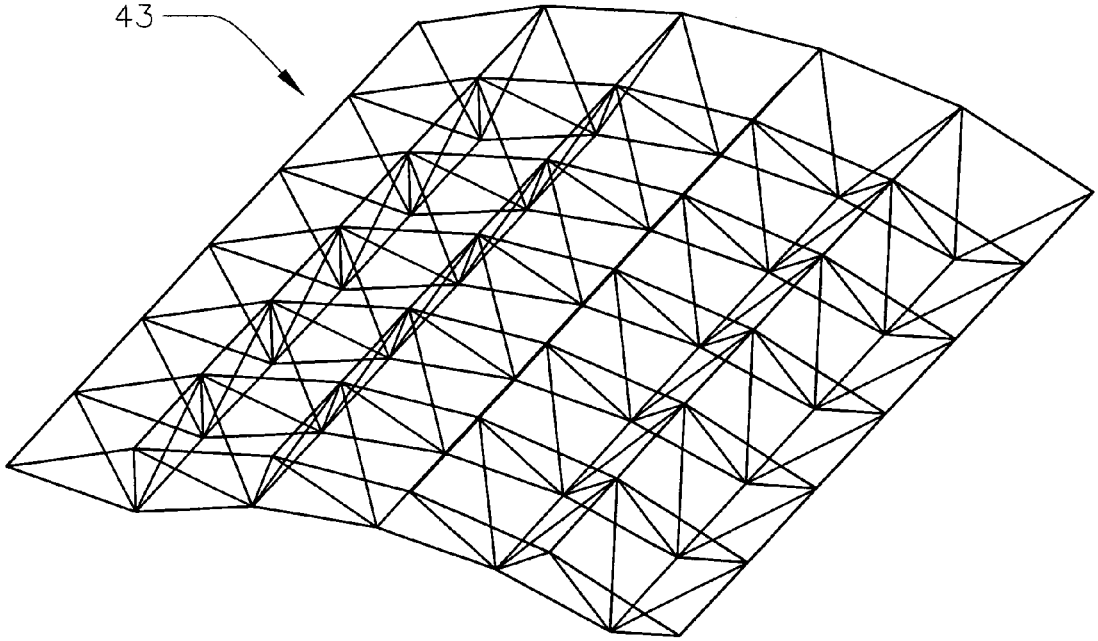
Figure 23:
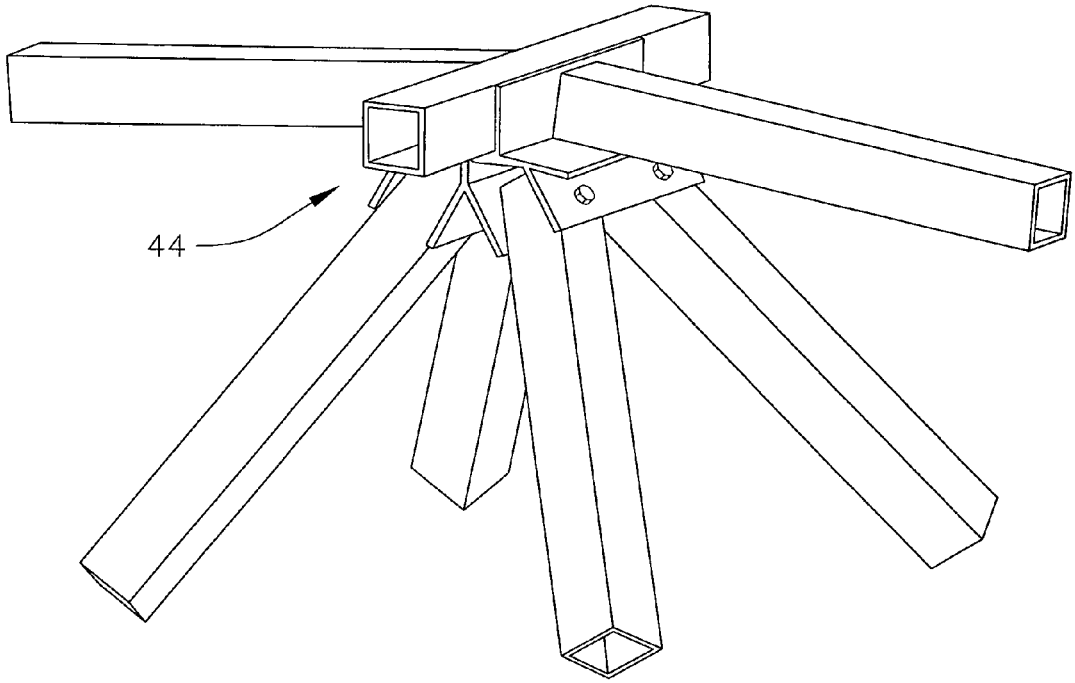
FIGS. 23, 24 and 25 are isometric, bottom and transverse sectional elevation views, respectively, of an extruded aluminum node of a vaulted DLG in which the framing elements are defined by square tubes.
Figure 24:
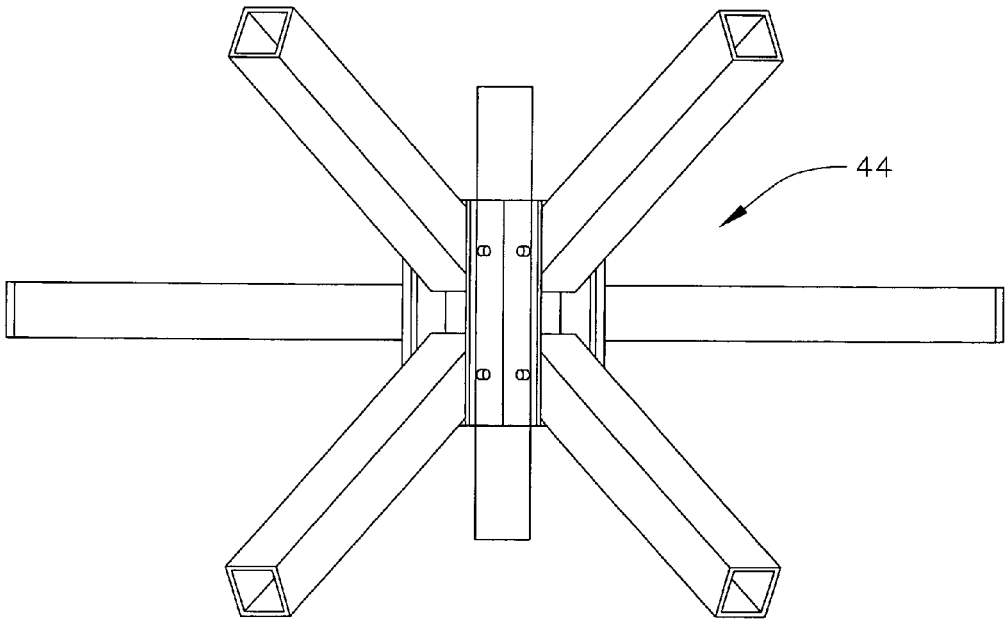
Figure 25:
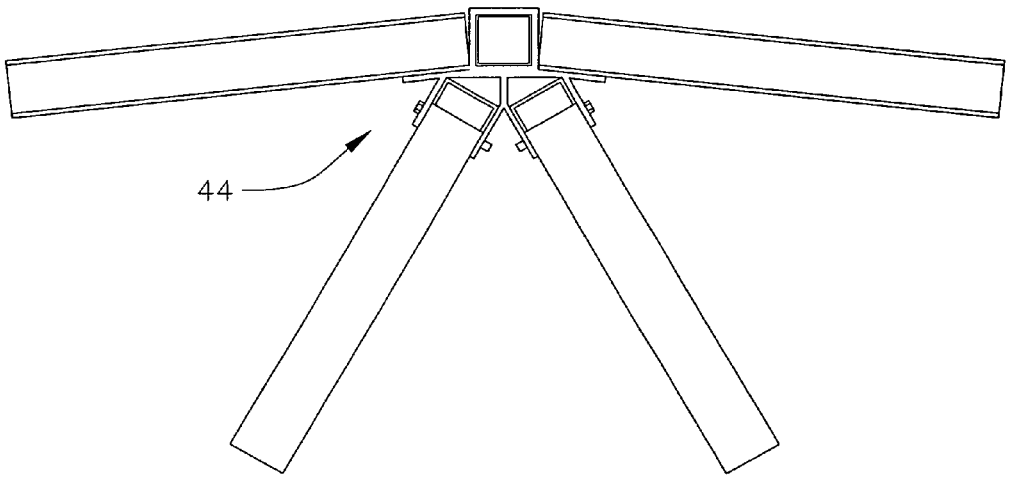
Figure 26:
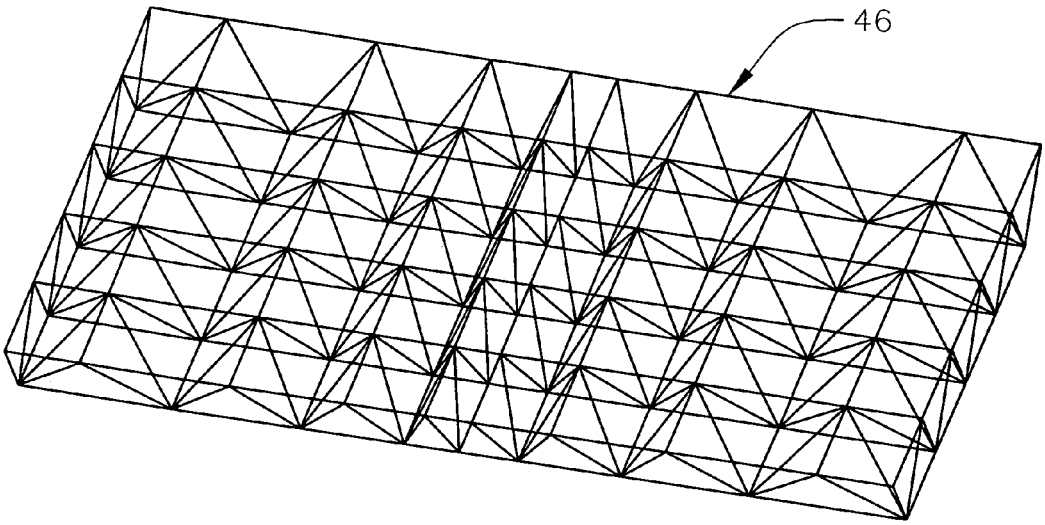
FIGS. 26, 27, 28 and 29 are isometric, top, side and end views, respectively, of a DLG with variable bay spacing in one direction.

FIGS. 21 and 22 show a double layer grid space frame that is shaped as an arch or vault. FIG. 21 shows the end view which demonstrates that the diagonal planes in the direction of that view are straight and uninterrupted which allows for the use of the DLGC in that direction. Note that the DLGC works easily in a direction at right angles to the direction of curvature for a vault. FIGS. 23 through 25 show an extruded DLGC aluminum node connector 44 joint used to create the shape of the vault. The joint is designed to create curvature by orienting the lateral surfaces and diagonal flanges at the needed angle—off from the 180 plane used in a flat double-layer-grid; compare FIG. 25 to FIG. 15. Again, such a joint could be produced with welded steel plates or pultruded FRP. The same joint design can be used throughout the structure with no change to the DLGC profile or to the bolt or pin patterns.

Figure 27:
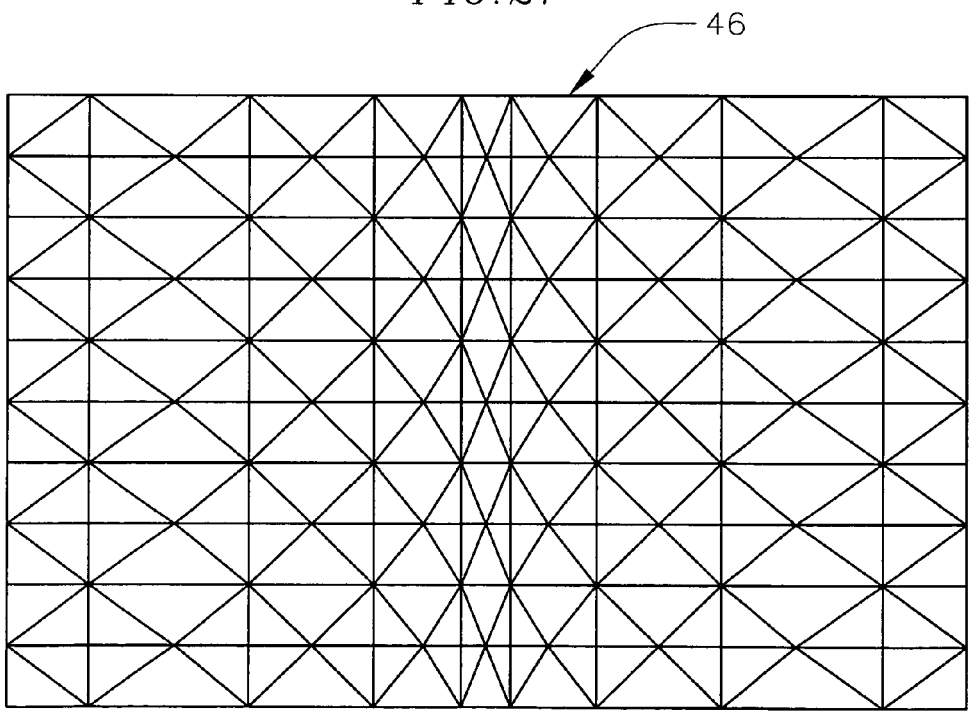
Figure 28:
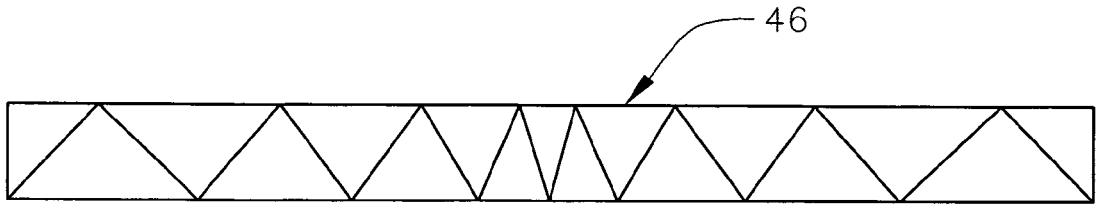
Figure 29:
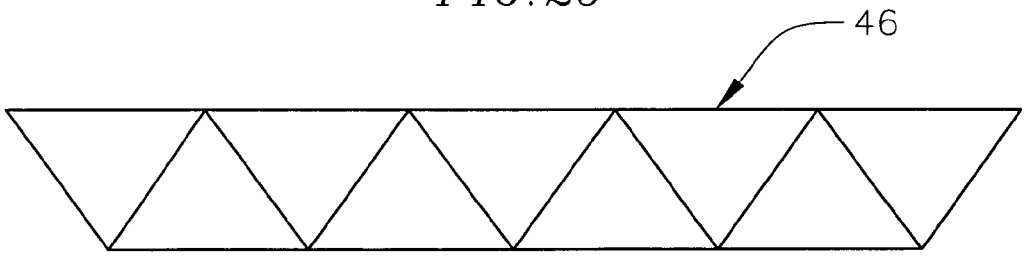

FIGS. 26 through 29 show a double-layer-grid space frame 46 with variable bay spacing in the longitudinal direction. FIG. 29 shows the end view which demonstrates that the longitudinal diagonal planes are straight and uninterrupted which allows for the use of the DLGC in that longitudinal direction. However, the bays running at 90 degrees from this view, as shown in FIG. 28, can be set at any regular or irregular spacing. As seen in FIG. 27, the grid forms rectangles with the long sides in the longitudinal direction starting from either end. The bay spacing progressively changes (reduces) going towards the center of the frame until the long direction of the rectangles follows the transverse direction of the frame. This does not effect any change in the end view; the diagonals all lie in the same plane. Again, the DLGC would be oriented in this longitudinal direction without change in profile. However, the drilled bolt or pin patterns in the diagonal flanges of the node connectors would require adjustment in the bolt pattern orientation and the diagonal strut lengths would change. The last set of diagonal struts at each end of frame 46 are brought up vertically in their diagonal planes to form frame end walls as seen in FIG. 28. A significant advantage to this feature (variable bay spacing) is that double-layer-grid space frames are no longer forced into square bay spacing which creates modular inflexibility in the structure. This allows the width and length of the double-layer-grid frame to be independent resulting in infinitely adjustable lengths versus widths. Also, as seen in FIG. 27, interesting architectural effects can be achieved by varying the bay spacing in the one direction. From a structural engineering point of view, this is an easy way to increase the framing member density in high stress areas of the frame. A variation of this is a tapered 3-sided tower.

Having thus disclosed various preferred working and other embodiments of the present invention, it will now be apparent that many additional node connector configurations and grid and truss system configurations can be achieved by virtue of and consistent with the advantageous teaching provided herein. Accordingly, the scope hereof will be limited only by the appended claims and their equivalents.

We claim:

1. A node connector useful for interconnecting plural structural framing members at a node in a double-layer space frame having spaced major surfaces including substantially orthogonally disposed chord members defining the frame major surfaces and including struts in diagonal planes oblique to the frame major surfaces, the struts spacing the major surfaces from each other, the node connector comprising an elongate body having substantially constant transverse cross-sectional configuration along its length and defining an elongate open-ended passage having side walls and configured and sized to enable a first chord member to be engaged in and along the passage between the side walls at a first connection node in one major surface of the frame, and at least first and second pairs of spaced parallel diagonal surfaces associated with respective ones of two diagonal planes which intersect at a line parallel to the elongate extent of the passage, the diagonal surfaces in each pair thereof being parallel to a respective diagonal plane and between which can be connected ends of a pair of frame struts.

2. A node connector according to claim 1 in which the connector body also defines two lateral surfaces extending respectively away from opposite sides of the passage and to each of which can be connected a further frame chord member disposed substantially orthogonally to the length of the passage.

3. A node connector according to claim 2 in which the lateral surfaces are substantially coplanar.

4. A node connector according to claim 2 in which the lateral surfaces lie in respective planes which intersect at a line parallel to the length of the passage.

5. A node connector according to claim 1 in which the line of intersection of the diagonal planes substantially coincides with a line along the center of the passage.

6. A node connector according to claim 1 in which the passage has a bottom and an open side opposite the bottom so that the body can be engaged laterally with the first chord member.

7. A node connector according to claim 6 in which the passage side walls are defined by the opposing surfaces of a pair of spaced parallel flanges defined by the connector body.

8. A node connector according to claim 7 in which each pair of diagonal surfaces is defined by the opposing surfaces of a pair of spaced parallel flanges defined by the connector body.

9. A node connector according to claim 1 in which each pair of diagonal surfaces is defined by the opposing surfaces of a pair of spaced parallel flanges defined by the connector body.

10. A node connector according to claim 1 in which the body is defined by an extrusion.

11. A double layer space frame having longitudinal and transverse chord structural framing members substantially orthogonally disposed in spaced major surfaces of the frame and connected relative to each other by connectors at connection nodes disposed in the respective frame major surfaces, the frame also including pairs of strut structural framing members lying in diagonal planes oblique to the frame major surfaces and which connect a node in one frame major surface to four adjacent nodes in the other frame major surface, a connector at such a node having at least two pairs of struts connected to it comprising a body having a passage through it which receives a first frame chord member, lateral surfaces extending away from opposite sides of the passage to each of which is connected a further chord member disposed substantially orthogonally to the first chord member, and at least two diagonal surfaces extending along the body parallel to the passage and respectively parallel to a respective one of two diagonal planes associated with that node and to which are connected ends of a respective pair of struts which connect that node to two adjacent nodes in the other frame major surface.

12. A double layer space frame according to claim 11 in which the passage has side walls between which the first frame chord member is disposed, and in which the connector body defines a pair of diagonal surfaces parallel to each diagonal plane, the surfaces of each pair of diagonal surfaces being parallel to each other and disposed on opposite sides of the related diagonal plane, the ends of the respective struts being disposed between the surfaces of each pair of diagonal surfaces.

13. A double layer space frame according to claim 11 in which the frame major surfaces are substantially flat, and the lateral surfaces defined by each connector body are substantially coplanar.

14. A double layer space frame according to claim 11 in which each pair of struts at each node has an angle between them which is the same angle between strut pairs at all other nodes in the frame.

15. A double layer space frame according to claim 11 wherein each pair of struts at each node forms an angle between them, and that angle at some nodes is different from that angle at other nodes in the frame.

16. A double layer space frame having longitudinal and transverse chord structural framing members substantially orthogonally disposed in spaced major surfaces of the frame and connected relative to each other by connectors at connection nodes disposed in the respective frame major surfaces, the frame also including pairs of strut structural framing members lying in diagonal planes oblique to the frame major surfaces and which connect a node in one frame major surface to two adjacent nodes in the other frame major surface, a connector at such a node having at least one pair of struts connected to it comprising a body having a passage through it which receives a first frame chord member, a lateral surface extending away from the passage to which is connected a second chord member disposed substantially orthogonally to the first chord member, and at least one diagonal surface extending along the body parallel to the passage and parallel to a diagonal plane associated with that node and to which are connected ends of the pair of struts which connect that node to two adjacent nodes in the other frame major surface.

* * * * *

UNITED STATES PATENT AND TRADEMARK OFFICE

CERTIFICATE OF CORRECTION

PATENT NO. : 7,530,201 B2
APPLICATION NO. : 10/932173
DATED : May 12, 2009
INVENTOR(S) : Reynolds et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 529 days.

Delete the phrase "by 529 days" and insert -- by 1021 days --

Signed and Sealed this

Eighteenth Day of May, 2010

David J. Kappos

David J. Kappos
*Director of the United States Patent and Trademark Office*